United States Patent [19]

Yunoki

[11] Patent Number: 4,860,619

[45] Date of Patent: Aug. 29, 1989

[54] ELONGATE ARTICLE PROCESSING APPARATUS WITH AN IMPROVED DISCHARGE DEVICE

[75] Inventor: Akio Yunoki, Namerikawa, Japan

[73] Assignee: Yoshida Kogyo K. K., Tokyo, Japan

[21] Appl. No.: 184,595

[22] Filed: Apr. 21, 1988

[30] Foreign Application Priority Data

Apr. 22, 1987 [JP] Japan ..... 62-100411

[51] Int. Cl.[4] ..... B21D 53/54; B26D 7/32; B65H 51/08

[52] U.S. Cl. ..... 83/80; 29/33.2; 83/110; 83/155; 83/156; 83/210; 83/261; 83/371; 83/921

[58] Field of Search ..... 83/110, 111, 112, 154, 83/155, 156, 921, 210, 261, 371, 80; 29/33.2, 408, 767, 768

[56] References Cited

U.S. PATENT DOCUMENTS

| | | | |
|---|---|---|---|
| 2,655,842 | 10/1953 | Baumgartner | 83/110 X |
| 3,376,772 | 4/1968 | Langwell | 83/154 |
| 3,754,908 | 7/1956 | Proud | 83/921 X |
| 3,902,954 | 9/1975 | Lotto | 83/156 X |
| 4,598,454 | 7/1986 | Yunoki | 29/33.2 |
| 4,606,100 | 8/1986 | Yunoki et al. | 29/33.2 |
| 4,674,739 | 6/1987 | Smith | 271/268 |

FOREIGN PATENT DOCUMENTS

| | | |
|---|---|---|
| 6080401 | 5/1985 | Japan . |
| 6085704 | 5/1985 | Japan . |

*Primary Examiner*—Frank T. Yost
*Assistant Examiner*—Hien H. Phan
*Attorney, Agent, or Firm*—Hill, Van Saten, Steadman & Simpson

[57] ABSTRACT

A discharge device incorporated in an elongate article processing apparatus includes a discharge unit disposed immediately downstream of a cutter of the apparatus and a conveyor unit extending downstream of the discharge unit. The discharge unit includes a drive roller and a vertically movable pinch roller, the pinch roller being held in its upper standby position remote from the drive roller while the cutter is in operation. The conveyor unit includes a presser roller vertically movable, in independent of the movement of the pinch rolller, into and out of engagement with a belt conveyor of the discharge unit.

1 Claim, 5 Drawing Sheets

ELONGATE ARTICLE PROCESSING APPARATUS WITH AN IMPROVED DISCHARGE DEVICE

BACKGROUND OF THE INVENTION

1. Field of the Invention

This invention relates to an apparatus for successively finishing or processing an elongate article such as a continuous slide fastener chain with flies into products of individual lengths such as slide fasteners with flies, and more particularly to a discharge device incorporated in such processing apparatus for discharging the finished products from the apparatus to a container.

2. Description of the Prior Art

Japanese Patent Laid-open Publication Nos. 60-80401 and 60-85704 disclose an apparatus for manufacturing slide fasteners with flies from a continuous slide fastener chain having flies attached thereto at longitudinal intervals. In manufacture, each of the flies is folded as the chain is fed along. After a slider is threaded on intermeshed rows of coupling elements, a bottom stop is applied. At the same time of the bottom stop application, the chain is cut by a chain cutter into individual product lengths. Though not disclosed in the above-mentioned publications, an attempt has been made to discharge the finished slide fasteners from the apparatus to a container by a belt conveyor disposed immediately downstream of the chain cutter.

Since the slide fastener with the fly wider than the slide fastener is asymmetric with respect to the longitudinal central line of the slide fastener, the slide fastener is likely to tilt in a lateral direction on, or sometimes fall from, the belt conveyor when the belt conveyor is driven at a high speed in synchronism with the operation of the apparatus. This drawback can be avoided by lowering the running speed of the belt conveyor below the operation of the apparatus, however, such low conveying speed results in a low rate of production of the slide fastener.

SUMMARY OF THE INVENTION

With the foregoing drawbacks in view, it is an object of the present invention to provide an elongate article processing apparatus including an improved discharge device which is capable of discharging finished products at a speed same as or greater than the speed of operation of the apparatus while keeping the products in a properly oriented posture without interferring cutting operation of a cutter.

According to the present invention, the foregoing and other objects are attained by a discharge device disposed downstream of a cutter of an apparatus for processing an elongate article into successive finished products, which device comprises a discharge unit disposed immediately downstream of the cutter and including a drive roller and a pinch roller coacting said drive roller for discharging the finished products, said pinch roller being vertically movable between a lower operating position to engage said drive roller and an upper standby position remote from said drive roller, said pinch roller being held in said upper standby position while the cutter is in operation; and a conveyor unit disposed downstream of said discharge unit and including a belt conveyor for conveying the finished products and a presser roller disposed above said belt conveyor for urging the products against said belt conveyor, said presser roller being vertically movable, in independent of the movement of said pinch roller, between a lower operating position to engage said belt conveyor and an upper standby position remote from said belt conveyor.

With this construction, since the presser roller continuously urge the finished product flatwise against an endless belt of the belt conveyor, the finished product can be fed on the belt conveyor in a neatly oriented posture. During this conveyance, the pinch rollers of the discharge unit is held in its upper standby position. Consequently, it is possible to operate the belt conveyor at a speed higher than the speed of operation of the discharge unit, thereby increasing the rate of production of the slide fastener. Since the pinch rollers are held in its upper standby position while the the cutter is in operation, the cutting of the elongate article can be achieved reliably and accurately.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 2 is a plane view, with parts cut away for clarity, of the discharge device;

DETAILED DESCRIPTION

Figure 1:
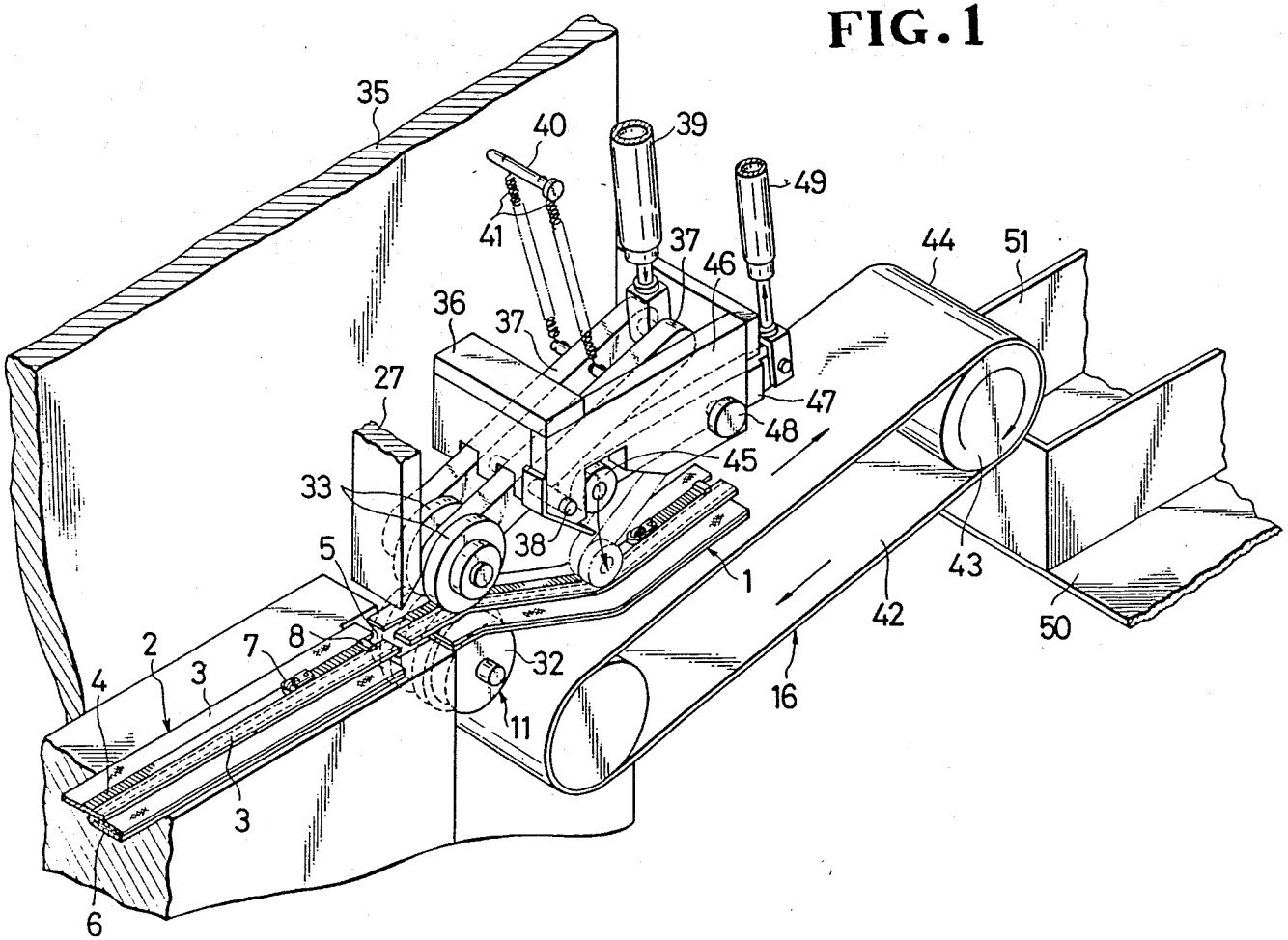

FIG. 1 shows the general construction of a discharge device embodying the present invention, the device being shown incorporated in an apparatus for automatically manufacturing slide fasteners 1 (only one shown) with flies attached thereto, successively from a slide fastener chain 2.

The slide fastener chain 2 is composed of a pair of continuous stringer tapes 3, 3 supporting a succession of intermeshed rows of coupling elements 4 on confronting longitudinal edges thereof with an element-free space or gap 5 in each of the intermeshed rows of coupling elements 4. A fly 6 wider than the slide fastener chain 2 is sewn to one of the stringer tapes 3 along a transversely substantially central portion of the fly 6.

As the slide fastener chain 2 travels along a feed path, the fly 6 is folded on itself about its sewn central portion, thus exposing the intermeshed rows of coupling elements 4. A slider 7 is put in the element-free space 5 and then threaded on the rows of coupling elements 4. Then a bottom stop 8 is applied to an end of the intermeshed rows of coupling elements 4, and the chain 2 is cut across the element-free space 5 into a predetermined length, thereby completing a slide fastener 1 with the fly 6.

Figure 7:
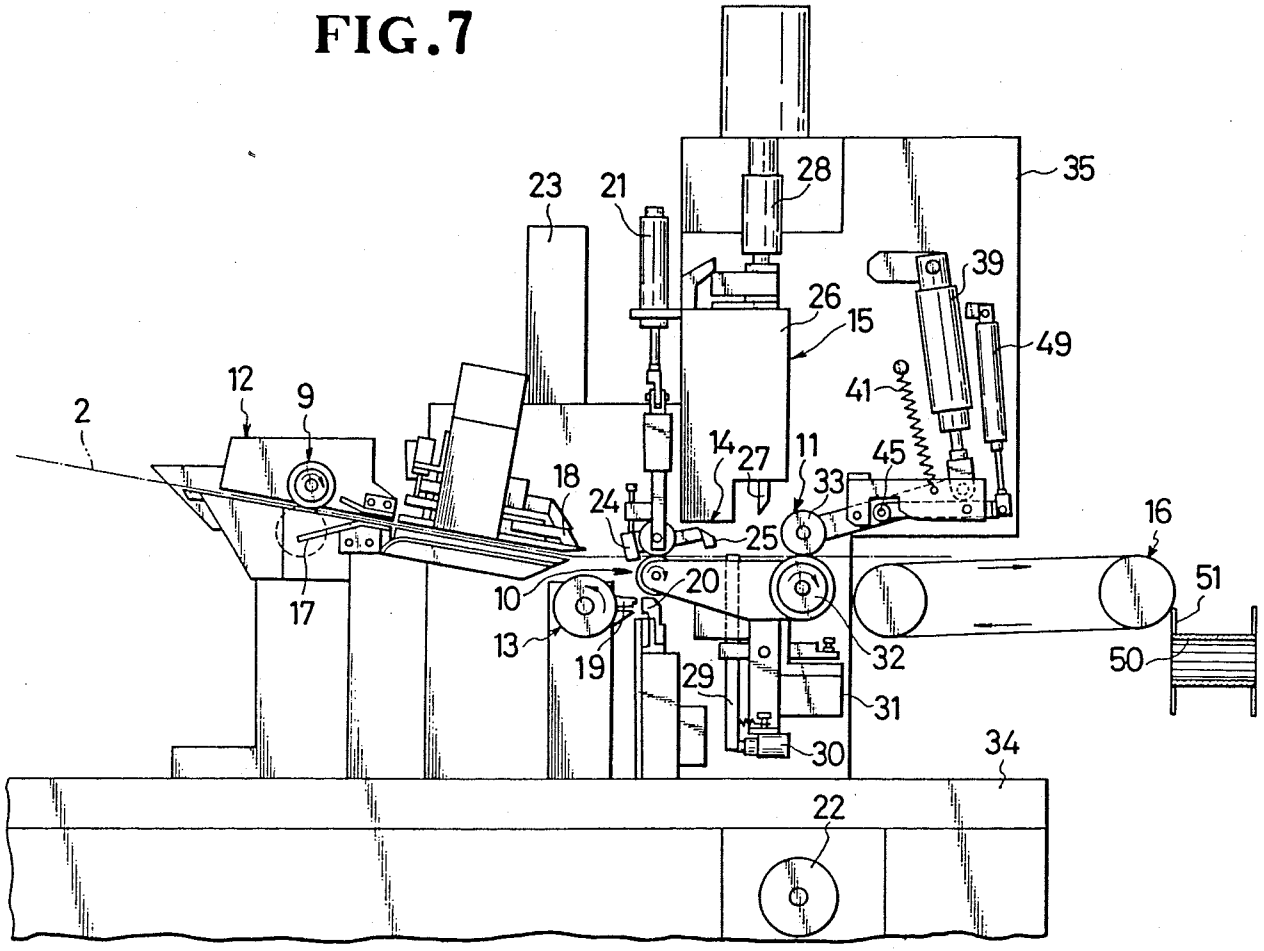
FIG. 7 is a schematic side elevational view of the fastener manufacturing apparatus.

As shown in FIG. 7, the chain feed path in the apparatus is defined by a guide roller assembly 9, a feed roller assembly 10 and a discharge unit 11 which constitute a part of the discharge device. The apparatus generally comprises a fly folder 12, a slider applicator 13, a bottom stop applicator 14 and a chain cutter 15 which are arranged in the order named along the chain feed path. The discharge device is disposed downstream of the chain cutter 15 and is composed of the discharge unit 11 and a conveyor unit 16 disposed downstream of the discharge unit 11.

The fly folder 12 includes an inclined guide plate 17 by means of which the fly 6 is folded on itself as the slide fastener chain 2 is fed along through the guide roller assembly 9, thus exposing the intermeshed rows of coupling elements 4, as shown in FIG. 1.

The slider applicator 13 includes a pair of chain splitters 18 (only one shown in FIG. 7) disposed above the chain feed path and movable to project into the element-free space 5 for spreading the same and splitting a leading end of the intermeshed rows of coupling elements 4. A slider holder 19 is disposed below the downstream ends of the chain splitters 18 and angularly movable between a lower horizontal position to receive the slider 7 from a chute 20 and an upper vertical position to place the slider 7 in the element-free space 5 as it is spread by the chain splitters 18. Then the chain splitters 18 are moved upwardly away from the element-free space 5 whereupon the stringer tapes 3 spring back inwardly toward each other, thereby causing the confronting tape edges to move into the slider 7 while the latter is held on the slider holder 19. During the course of action stated above, the movement of the slide fastener chain 2 is temporarily stopped and the chain 2 is kept under tension. Then the feed roller assembly 10 is driven again to advance the slide fastener chain 2, so that the slider 7 is threaded on the intermeshed rows of coupling elements 4.

The feed roller assembly 10 comprises a pair of upper and lower rollers (not designated) for feeding the intermeshed rows of coupling elements 4. The upper roller is operatively connected with a first fluid cylinder 21 for vertical reciprocating movement relative to the lower roller. The lower roller serves as a drive roller and is driven by a motor 22 and a second fluid cylinder 23 via a non-illustrated rack-and-pinion mechanism. The motor 22 is energized to rotate the lower roller for feeding the slide fastener chain 2 until the chain splitters 18 enter the element-free space 5. The second fluid cylinder 23 is thereafter actuated to drive the lower roller for threading the slider 7 onto the rows of coupling elements 4.

A rockable lever having first and second element guides 24, 25 at its opposite ends is disposed adjacent to the feed roller assembly with the element guides 24, 25 located forwardly and rearwardly of the upper roller. The lever is angularly moved in timed relation to the movement of the upper roller to alternately engage the intermeshed rows of coupling elements 4 for guiding the latter.

The bottom stop applicator 14 and the chain cutter 15 are vertically movably disposed in a casing 26 and generally comprise a punch (not shown) and a cutter 27 drivable by a third fluid cylinder 28. In synchronism with a downward movement of the punch, a bottom stop blank wire supplied horizontally below the punch is cut off. A blank wire length thus severed is bent into a U-shaped bottom stop which is then applied to the leading end of the intermeshed rows of coupling elements 4 by the punch, while at the same time the chain 10 is transversely cut off across the element-free space 5.

In order to stop the forward movement of the slide fastener chain, there is provided a vertical stop bar 29 normally urged upwardly into sliding engagement with a lower surface of the intermeshed rows of coupling elements 4. When an element-free space 5 in the slide fastener chain 2 reaches the upper end of the stop bar 29, the stop bar 29 projects into the element-free space 5. The upward movement of the stop bar 29 is detected by a sensor 30 which issues a control signal to de-energize the motor 22, thereby de-activating the feed roller assembly 10. A fourth fluid cylinder 31 is operatively connected with the stop bar 29 to lower the stop bar 29 for clearing the element-free space 5 when the slide fastener chain 2 is to be fed along again. The aforementioned stop bar 29 and the sensor 30 are also shown in FIGS. 3 through 6 in which they are arranged in a manner different from that shown in FIG. 7 for purposes of illustration.

Figure 2:
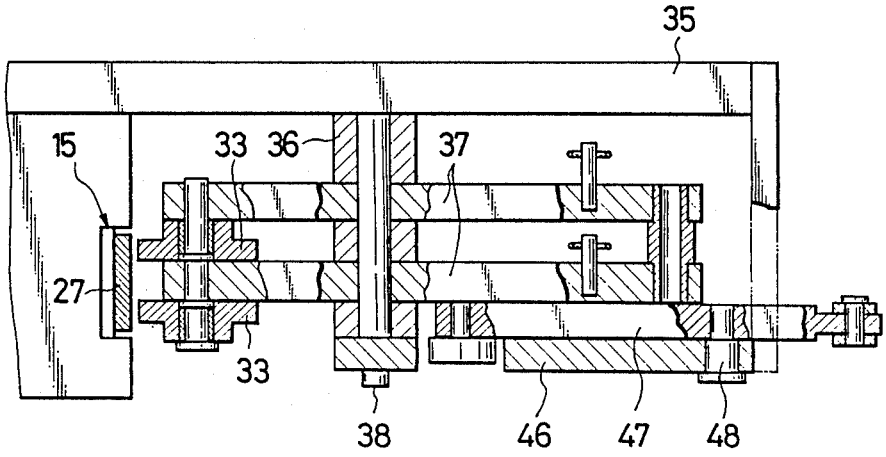
FIG. 2 is a fragmentary perspective view of a discharge device incorporated in a slide fastener manufacturing apparatus.

As shown in FIGS. 1 and 2, the discharge unit 11 is composed of a lower drive roller 32 and a pair of laterally spaced upper idle or pinch rollers 33 coacting with the drive roller 32 for discharging a finished slide fastener 1 in sandwiching relation. The drive roller 32 is continuously driven while the apparatus is in operation and is circumferentially grooved for allowing passage therethrough of the slider 7 as the stringer tapes 3 are fed by and between the drive and pinch rollers 32, 33. The pinch rollers 33 are vertically movable between a lower operating position to engage the drive roller 32 and an upper standby position remote from the drive roller 32. Each of the pinch rollers 33 is rotatably mounted on one end of a lever 37 pivotably connected by a pin 38 to a bracket 36 mounted on a vertical mount plate 35 secured to a bed or base 34. The other end of the lever 37 is pivotably connected to a piston rod of a fifth fluid cylinder 39 supported on the vertical mount plate 35. Thus, the levers 37 are pivotably movable to vertically reciprocate the pinch rollers 33 between the lower operating position and the upper standby position in response to operation of the fifth fluid cylinder 39. The pinch rollers 33 are normally urged against the drive roller 32 by means of a pair of tension coil springs 41 acting between the respective levers 37 and retainer pins 40 secured to the vertical mount plate 35.

As shown in FIGS. 1, 2 and 7, the conveyor unit 16 is composed of a belt conveyor 42 extending downstream of the discharge unit 11 and a presser roller 45 disposed above the belt conveyor 42 and coacting with the same for conveying the finished slide fastener 1. The belt conveyor 42 includes a drive roller 43 rotatable in a direction of the arrow shown in FIG. 1 to travel an endless belt 44 around the drive roller 43 and a guide roller (not designated) disposed near the discharge unit 11. The presser roller 45 is rotatably mounted on one end of a lever 47 pivotably connected by a pin 48 to a vertical support plate 46 mounted on the bracket 36. The other end of the lever 47 is pivotably connected to a piston rod of a sixth fluid cylinder 49 supported on the vertical mount plate 35. Thus, the lever 47 is pivotably movable to bring the presser roller 45 into and out of engagement with the endless belt 44. The presser roller 45 is normally held in an upper standby position remote from the conveyor belt 44.

Figure 3:
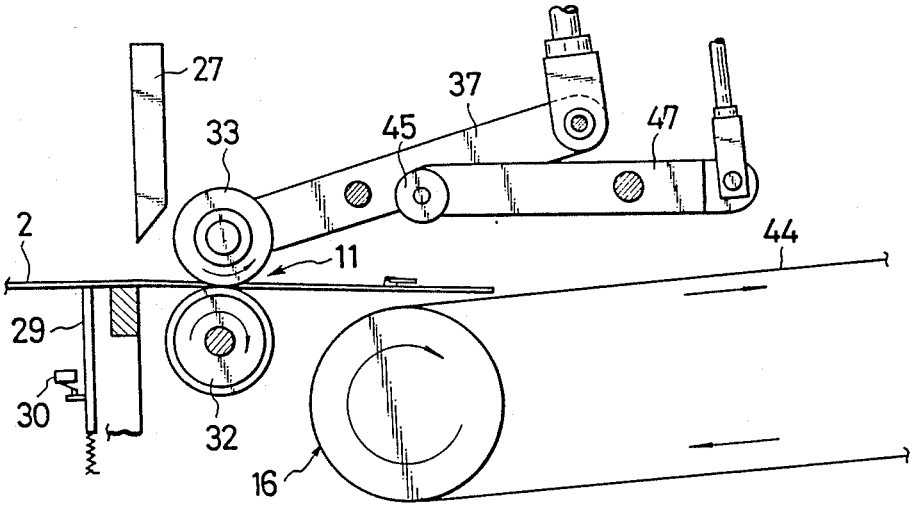
FIGS. 3 through 6 are diagrammatic side elevational views illustrative of a sequence of steps of operation of the discharge apparatus.

The operation of the fifth and sixth fluid cylinders 39, 49 and hence movement of the pinch rollers 33 and the presser roller 45 is controlled by the control signal issued from the sensor 30 when the vertical stop bar 29 moves upwardly. While the stop bar 29 is kept in its retracted position as shown in FIG. 3, the fifth fluid cylinder 39 is de-activated so that the pinch rollers 33 are urged downwardly to force the slide fastener chain 2 against the drive roller 32. At the same time, the sixth fluid cylinder 49 is activated to thereby hold the presser roller 45 in its upper standby position remote from the endless belt 44 of the belt conveyor 42.

Figure 4:
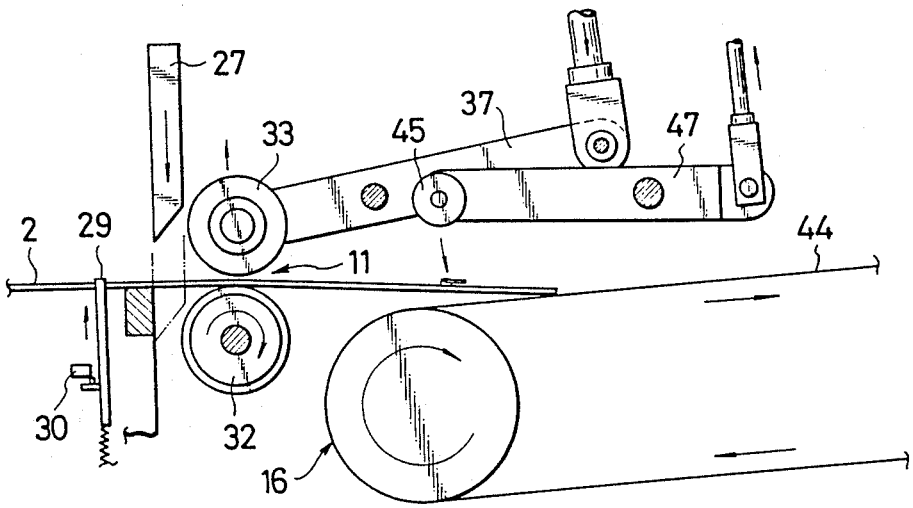
Figure 5:
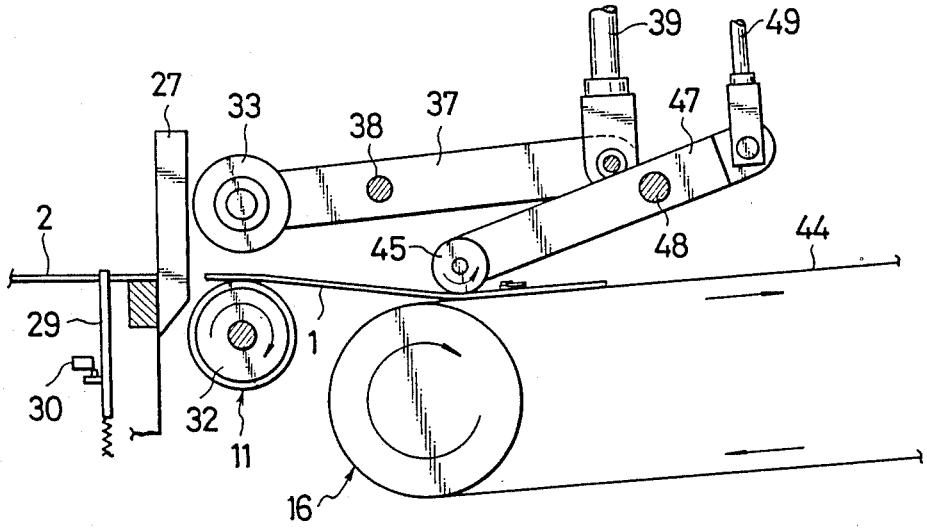

A continuous forward movement of the slide fastener chain 2 causes the stop bar 29 to move upwardly into an element-free space 5 whereupon the sensor 30 issues a control signal to the motor 22, thereby stopping the operation of the feed roller assembly 10. This control signal is also sent to the fifth and sixth fluid cylinders 39, 49, the bottom stop applicator 14 and the chain cutter 15. Upon receipt of the control signal, the fifth fluid cylinder 39 extends its piston rod to pivot the levers 37 clockwise to move the pinch rollers 33 upwardly away from the drive roller 32. On the other hand, substantially at the same time or slightly after the beginning of the upward movement of the pinch rollers 33, the sixth fluid cylinder 49 retracts its piston rod to pivot the lever 47 counterclockwise to lower the presser roller 45. The punch of the bottom stop applicator 14 and the cutter 27 of the chain cutter 15 are lowered to apply a bottom stop 8 and cut off a slide fastener 1 from the slide fastener chain 2 (FIG. 4 to FIG. 5).

Figure 6:
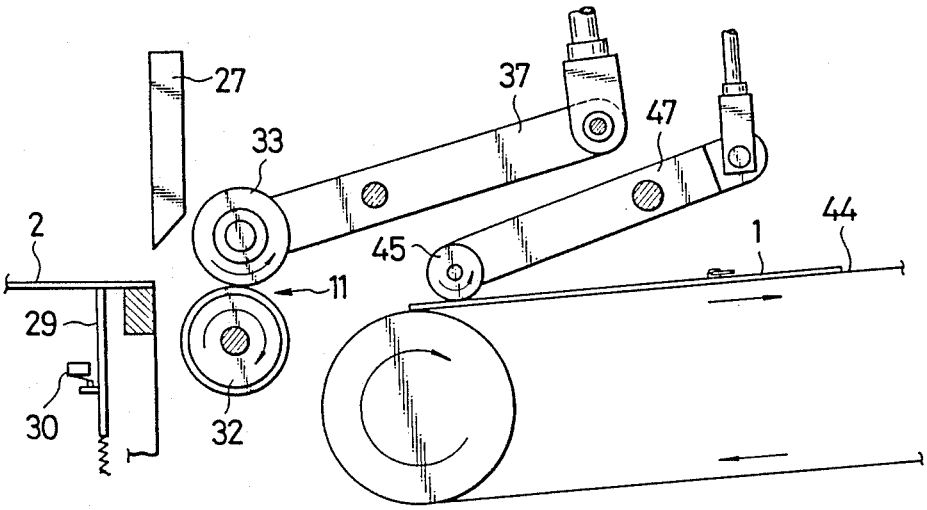

The severed slide fastener 1 is conveyed on the belt conveyor 42 while it is forced flatwise against the endless belt 44 by the presser roller 45. During that time, the punch and the cutter 27 are moved upwardly in preparation for the next cycle of operation. When the slide fastener 1 is completely passed through the discharge unit 11, the fifth cylinder 39 is de-activated to thereby bring the pinch rollers into engagement with the drive roller 32, as shown in FIG. 6. Thus the stop bar 29 is lowered whereupon the feed roller assembly 10 is driven to advance the slide fastener chain 2 again along the feed path. The foregoing steps of operation are repeated until a desired number of finished slide fasteners are produced. When the trailing end of the slide fastener 1 is moved past the presser roller 45, the sixth fluid cylinder 49 is activated to move the presser roller 45 upwardly away from the belt conveyor 42. The slide fastener 1 is transferred from the belt conveyor 42 into a container 51 carried on an unload conveyor 50 extending transverse to the discharge conveyor 42.

Obviously, various modifications and variations of the present invention are possible in the light of the above teaching. It is therefore to be understood that within the scope of the appended claims the invention may be practiced otherwise than as specifically described.

What is claimed is:

1. An apparatus for successively processing an elongate article into finished products as the article is fed longitudinally, the apparatus including a cutter disposed under the control of a sensor to sever the elongate article into products of individual lengths, and a discharge device for discharging the finished products, said discharge device comprising:

(a) a discharge unit disposed immediately downstream of the cutter and including a continuously rotating drive roller and a pinch roller coacting with said drive roller for discharging the finished products, and further including a pivot lever and a fluid cylinder pivotably connected to one of opposite ends of said pivot lever, said pinch roller being rotatably supported on the other end of said pivot lever, said pinch roller being vertically movable in response to the operation of said fluid cylinder between a lower operating position to engage said drive roller and an upper standby position remote from said drive roller, said pinch roller being held in said upper standby position while the cutter is in operation; and (b) a conveyor unit disposed downstream of said discharge unit and including a belt conveyor for conveying the finished products and a presser roller disposed above said belt conveyor for urging the products against said belt conveyor, and further including a pivot lever and a fluid cylinder pivotably connected to one of opposite ends of said pivot lever, said presser roller being rotatably supported on the opposite end of said pivot lever, said presser roller being vertically movable in response to the operation of the least-named fluid cylinder between a lower operating position to engage said belt conveyor and an upper standby position remote from said belt conveyor, said pinch roller being normally held in said lower operating position, said presser roller being normally held in said upper standby position and operatively linked with said pinch roller such that said presser roller is moved under the control of said sensor from said upper standby position to said lower operating position substantially at the same time or slightly after the beginning of movement of said pinch roller from its lower operating position to said upper standby position.

* * * * *